US005245104A

United States Patent [19]

Cullick

[11] Patent Number: 5,245,104

[45] Date of Patent: Sep. 14, 1993

[54] METHOD AND APPARATUS FOR PRODUCING AND SEPARATING DIAMONDOID COMPOUNDS FROM NATURAL GAS STREAMS

[75] Inventor: Alvin S. Cullick, Dallas, Tex.

[73] Assignee: Mobil Oil Corporation, Fairfax, Va.

[21] Appl. No.: 628,958

[22] Filed: Dec. 17, 1990

[51] Int. Cl.[5] ..... C07C 7/00; C07C 7/14

[52] U.S. Cl. ..... 585/812; 585/800; 585/803

[58] Field of Search ..... 585/812, 803

[56] References Cited

U.S. PATENT DOCUMENTS

| | | | |
|---|---|---|---|
| 3,082,211 | 4/1957 | Green | 585/815 |
| 4,666,456 | 5/1987 | Thijssen et al. | 23/296 |
| 4,952,747 | 8/1990 | Alexander et al. | 585/803 |
| 4,952,748 | 8/1990 | Alexander et al. | 585/803 |
| 4,952,749 | 8/1990 | Alexander et al. | 585/803 |

*Primary Examiner*—Asok Pal
*Assistant Examiner*—P. Achutamurthy
*Attorney, Agent, or Firm*—Alexander J. McKillop; Dennis P. Santini; Robert B. Furr, Jr.

[57] ABSTRACT

A method and apparatus are disclosed for recovering and separating diamondoid compounds from a produced natural gas stream containing dissolved diamondoids.

9 Claims, 1 Drawing Sheet

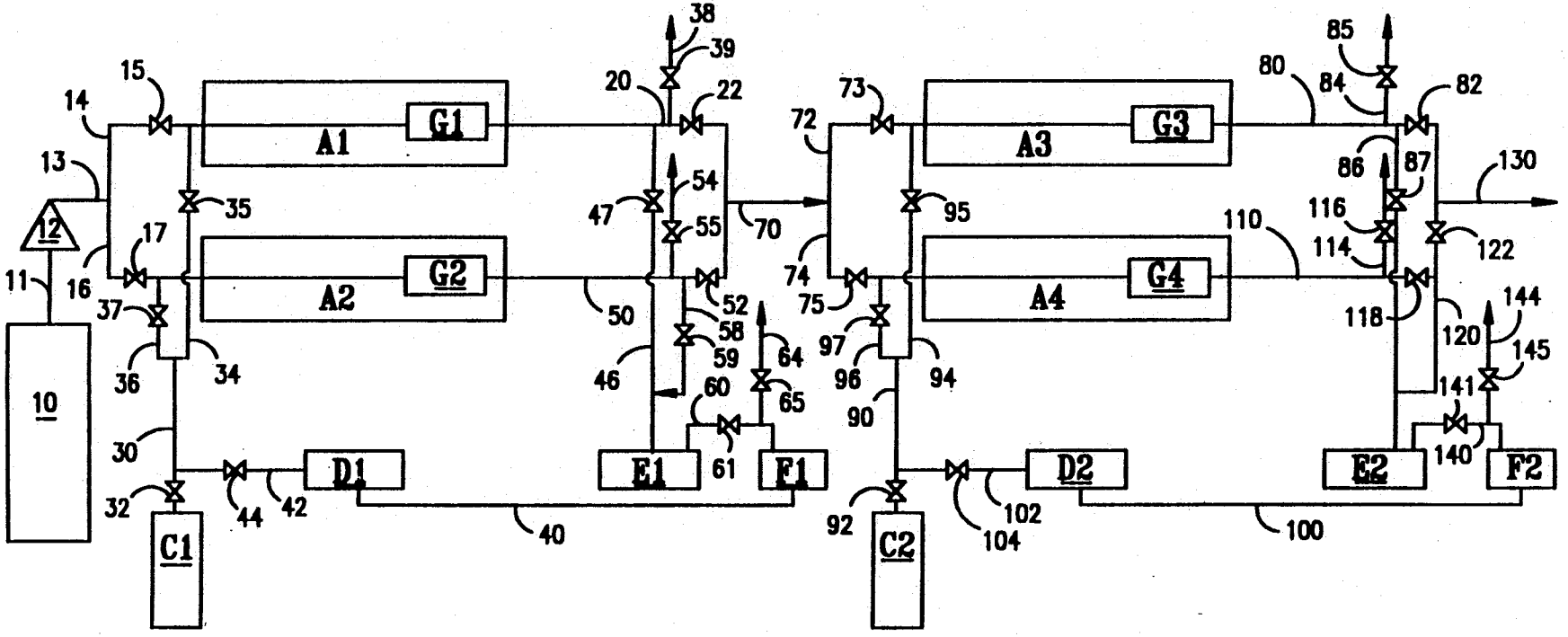
A1
A2
A3
A4
G1
G2
G3
G4
C1
C2
D1
D2
E1
E2
F1
F2
10
11
12
13
14
15
16
17
20
22
30
32
34
35
36
37
38
39
40
42
44
46
47
50
52
54
55
58
59
60
61
64
65
70
72
73
74
75
80
82
84
85
86
87
90
92
94
95
96
97
100
102
104
110
114
116
118
120
122
130
140
141
144
145

METHOD AND APPARATUS FOR PRODUCING AND SEPARATING DIAMONDOID COMPOUNDS FROM NATURAL GAS STREAMS

BACKGROUND OF THE INVENTION

This invention relates to the controlled recovery of certain components from hydrocarbon streams. It more particularly refers to recovering and separating diamondoid organic compounds from hydrocarbon streams containing such, and specifically to precipitating these diamondoid compounds in a manner which facilitates their separate recovery.

Many hydrocarbonaceous mineral streams contain some small proportion of diamondoid compounds. These high boiling, saturated, three-dimensional polycyclic organics are illustrated by adamantane, diamantane, triamantane and various side chain substituted homologues, particularly the methyl derivatives. These compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules*, Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presence of diamondoid compounds in natural gas has been found to cause plugging in the process equipment requiring costly maintenance downtime to remove. On the other hand, these very compounds which can deleteriously affect the profitability of natural gas production are themselves valuable products.

The problem of diamondoid deposition and plugging in natural gas production equipment has been successfully addressed by a controlled solvent injection process. U.S. Pat. No. 4,952,748 to Alexander and Knight teaches the process for extracting diamondoid compounds from a hydrocarbon gas stream by contacting the diamondoid-laden hydrocarbon gas with a suitable solvent to preferentially dissolve the diamondoid compounds into the solvent. Allowed U.S. patent application Ser. No. 489,111, filed Mar. 6, 1990, to Cullick and Roach teaches a method for locating the solvent injection point within the natural gas wellbore.

Further studies have revealed that separation of the diamondoid compounds from the diamondoid-enriched solvent is complicated by the fact that numerous diamondoid compounds boil in a narrow range of temperatures surrounding the boiling range of the most preferred solvents. U.S. Pat. Nos. 4,952,747 and 4,952,749 to Alexander et al. as well as allowed U.S. application Ser. No. 358,761, filed May 26, 1989 teach various methods of concentrating diamondoid compounds in the solvent for, among other reasons, recycling the lean solvent fraction for reuse Each of these processes produces an enriched solvent stream containing a mixture of diamondoid compounds. While the produced diamondoid mixture may prove useful itself, it is presently desirable to segregate the various diamondoid homologs for further processing. Thus it would be highly desirable to provide a method for preventing diamondoid deposition and plugging in hydrocarbon gas production and processing equipment which effectively separates the produced diamondoid mixture into fractions enriched in a single diamondoid homolog.

SUMMARY OF THE INVENTION

The present invention provides a method for recovering diamondoid compounds from a natural gas stream and for separating these compounds into fractions which are each enriched in a single diamondoid homolog.

Thus the invention provides a method for recovering diamondoid compounds from a hydrocarbon gas stream in a plurality of diamondoid fractions, wherein each recovered diamondoid fraction is enriched in a selected diamondoid homolog.

The method of the invention comprises the steps of:

(a) providing a natural gas reservoir containing a recoverable concentration of diamondoid compounds dissolved therein;

(b) withdrawing a natural gas stream containing diamondoid compounds from said natural gas reservoir at production wellhead pressure;

(c) depressuring and heating said natural gas stream to maintain said diamondoid compounds in solution with said natural gas;

(d) transferring said depressured natural gas stream of step (c) to a first precipitation zone while controlling temperature and pressure to maintain said diamondoid compounds in solution with said natural gas upstream of said first precipitation zone;

(e) cooling said depressured natural gas stream of step (d) within said first precipitation zone to a temperature sufficient to evolve a triamantane-enriched precipitate;

(f) collecting said triamantane-enriched precipitate within said first precipitation zone in the substantial absence of diamantane-enriched precipitate;

(g) discontinuing natural gas flow to said first precipitation zone;

(h) flushing said first precipitation zone with a solvent to dissolve said triamantane-enriched precipitate, said solvent being characterized by boiling point range at atmospheric pressure of from about 70° to about 125° F.;

(i) collecting said triamantane-enriched solvent of step (h);

(j) recovering triamantane-enriched product from said collected solvent of step (i);

(k) transferring said cooled depressured natural gas stream of step (e) to a second precipitation zone while controlling temperature and pressure to retain the remaining diamondoid compounds in solution with said natural gas upstream of said second precipitation zone;

(l) cooling said depressured natural gas stream of step (d) within said second precipitation zone to a temperature sufficient to evolve a diamantane-enriched precipitate;

(m) collecting said diamantane-enriched precipitate within said second precipitation zone in the substantial absence of triamantane-enriched precipitate;

(n) discontinuing natural gas flow to said second precipitation zone;

(o) flushing said second precipitation zone with a solvent to dissolve said diamantane-enriched precipitate, said solvent being characterized by boiling point range at atmospheric pressure of from about 70° to about 125° F.;

(p) collecting said diamantane-enriched solvent of step (o); and (q) recovering diamantane-enriched product from said collected solvent of step (p).

The process may further comprise accumulating said diamondoid-enriched precipitate on porous solids within said precipitation zones of steps (d) and (l). The porous solid may comprise any suitable inert porous material which remains thermally stable under the broad ranges of temperature and pressure specified for the precipitation zone. One examples of a suitable porous solid is a metallic filter, i.e., a sintered metal filter.

Solvents useful in the present invention must readily dissolve diamondoid compounds such as diamantane and triamantane. These solvents must also remain liquid under typical ambient conditions but readily vaporize under atmospheric pressure at temperatures slightly above ambient. Examples of suitable solvents include naphtha, carbon disulfide, and chloroform, with carbon disulfide being the most preferred solvent. Of the useful naphtha boiling range solvents, naphthenic hydrocarbon mixtures enriched in cyclohexane are preferred, and neat cyclohexane is particularly preferred. If the selected naphtha comprises a mixture of components, the naphtha should preferably have an endpoint of less than about 125° F.

The invention further provides an apparatus for recovering a plurality of diamondoid-enriched solid fractions from a gas stream having a mixture of diamondoid compounds dissolved therein, said apparatus comprising:

(a) a first precipitation stage containing at least two precipitation zones piped and valved together in parallel with a common inlet and a common outlet for selectively flowing a gas stream through one of said precipitation zones in a parallel/swing operational mode or through both of said precipitation zones simultaneously in parallel;

(b) a second precipitation stage containing at least two precipitation zones piped and valved together in parallel with a common inlet and a common outlet for selectively flowing a gas stream through one of said precipitation zones in a parallel/swing operational mode or through both of said precipitation zones simultaneously in parallel;

(c) valved conduit operatively connecting said first precipitation stage outlet with said second precipitation stage inlet;

(d) a first precipitation stage temperature controller for maintaining temperature of said first precipitation stage within a first preselected range;

(e) a second precipitation stage temperature controller for maintaining temperature of said second precipitation stage within a second preselected range;

(f) an inert gas source for selectively flowing inert gas through at least one precipitation zone of said first and said second precipitation stages;

(g) at least one solvent reservoir with associated solvent supply valved conduit for selectively passing solvent through at least one precipitation zone of said first and said second precipitation stages to dissolve diamondoid-containing solids deposited therein whereby said solvent is enriched in diamondoid compounds; and (h) a first solvent evaporator for collecting and evaporating enriched solvent which has been circulated through said first precipitation stage;

(i) a second solvent evaporator for collecting and evaporating enriched solvent which has been circulated through said second precipitation stage; and (j) conduit for returning condensed solvent from said first solvent evaporator and said second solvent evaporator to said solvent reservoir.

DESCRIPTION OF THE DRAWING

The FIGURE is a simplified schematic flow diagram illustrating the major processing steps of the present invention.

DETAILED DESCRIPTION

The present invention provides a method and apparatus for recovering diamondoid compounds from a hydrocarbon gas stream, e.g., a produced natural gas stream. The process of the invention may optionally be operated in a diamondoid production mode or in a diamondoid production/separation mode. If the diamondoid production mode is selected, a single precipitation stage is employed under temperature conditions to precipitate substantially all of the diamondoid compounds dissolved in the natural gas stream. This mode is useful for producing solid mixtures of diamondoid compounds which reflect the diamondoid composition of the produced natural gas stream. However, in certain circumstances, it is desirable to segregate the diamondoid compounds by structure, i.e., to separate higher adamantane homologs from lower adamantane homologs, and specifically to separate diamantane from triamantane. The invention accomplishes this object by segregating triamantane in a first precipitation stage from diamantane in a second precipitation stage by tailoring conditions within the precipitation stages to selectively precipitate solids enriched in these diamondoid materials. As used herein, the term "adamantane homolog" designates the substituted and unsubstituted polycyclic alkanes having a skeletal structure resembling diamond, examples of which include adamantane, diamantane, and triamantane, as well as their substituted and functionalized derivatives.

Process Flow

The production/separation mode of the present invention is schematically shown in the FIGURE, and parallel/swing operation is described below. It is to be understood, however, that if necessary, both parallel circuits can be operated simultaneously.

Referring now to the FIGURE, a diamondoid-containing natural gas stream is withdrawn from a producing natural gas well 10 through line 11 at wellhead pressure which generally ranges from about 2,000 to about 15,000 psig, most typically around about 6,000 psig, and temperature of from about 200° F. to about 300° F. The produced natural gas stream is depressured across choke valve 12 to a pressure of from about 900 to about 1400 psig, typically around 1200 psig. To avoid uncontrolled precipitation of solids, particularly diamondoids, due to Joule-Thompson cooling across the choke, the natural gas lines and valves downstream from the choke are heat traced, e.g., with steam or electric heat tracing (not shown). The heat tracing suitably maintains the natural gas lines downstream from the choke at temperatures in the range of about 200° F. to about 260° F. The depressured natural gas stream then flows through choke outlet line 13 and is teed into lines 14 and 16, which are suitably valved 15, 17 to charge the diamondoid-containing natural gas stream to at least one of two temperature-controlled precipitations zones, G1 and G2, which are configured for parallel/swing operation as described in greater detail below.

To collect a triamantane-enriched solid in the first precipitation zone, G1, valve 15 is set open, allowing depressured diamondoid-containing natural gas to enter first precipitation zone G1 which is in contact with cooler Al. Precipitation zone G1 comprises a tubular conduit which preferably contains a porous solid material to facilitate triamantane precipitation. Examples of suitable porous solids include metallic filters, for example a sintered metal filter. Examples of other suitable porous solids include, metal balls or metal filings. Inert porous nonmetallic solids may also be used, for example, alumina balls.

Temperature control in first precipitation zone G1 is critical for effective diamondoid separation in the present invention. For this reason, it is preferred that the total heat capacity of cooler A1 be relatively large compared to the required cooling load in first precipitation zone G1. To precipitate triamantane-enriched solids in the first precipitation zone G1, the temperature is preferably controlled at around 190° F. The cooler A1 and precipitation zone G1 can be of any suitable configuration and it is preferred that the precipitation zone G1 and cooler A1 be constructed as a shell-and-tube heat exchanger. In this configuration, the precipitation zone G1 most preferably comprises a coiled tube immersed in a circulating water bath contained within the shell of the heat exchanger.

The natural gas stream is then withdrawn from first precipitation zone G1 through line 20 which is equipped with valve 22. As precipitate accumulates within first precipitation zone G1, the available paths for gas flow are constricted and pressure drop across the precipitation zone gradually increases. Thus pressure drop across the precipitation zone is a useful indicator of precipitate loading. When the pressure drop reaches a predetermined level, typically about 1–2 psi, but not exceeding 10 psi, natural gas flow through the first precipitation zone G1 is interrupted and the natural gas is routed through the second precipitation zone G2 which is piped in parallel with first precipitation zone G1. Valve 15 is closed, and valve 17 is opened, shifting flow from line 14 to line 16. Temperature conditions within the second precipitation zone G2 are equivalent to those in the first precipitation zone G1 during the precipitation step.

The accumulated triamantane-rich precipitate is then collected from the first precipitation zone G1. First, the zone is purged with a cold inert gas such as vaporized carbon dioxide to cool the precipitation zone and to remove natural gas from the precipitation zone and associated lines. This purging step is accomplished by withdrawing liquid carbon dioxide contained in C1 and stored at about 800 psi. The liquid is withdrawn into lines 30 and 34 by opening valve 32. With G1 now open to the flare (at atmospheric pressure), the liquid carbon dioxide is flashed across valve 35, which is a needle valve or other valve whose effective orifice size can be controlled to ensure that line 34 remains liquid filled until after the cooling step. By Joule-Thompson cooling, the vaporized carbon dioxide is at a temperature well below 40° F. The cool carbon dioxide gas stream enters and flushes natural gas from first precipitation zone G1 which is then exhausted to flare via line 38 through open valve 39. The flushing continues until the temperature of G1 reaches about 70° F. During the inert gas flushing step, the circulating water in cooler A1 is preferably drained to a level below that of the precipitation zone G1 to facilitate cooling of the precipitation zone G1 by the cool vaporized inert gas.

Following the inert gas purge, the first precipitation zone G1 is flushed with a solvent such as carbon disulfide, chloroform, or a naphtha having an endpoint of less than about 125° F, as described above. Solvent flows from fresh solvent reservoir F1 through line 40 to solvent pump D1. The solvent pump must generate sufficient pressure to overcome the pressure drop in the precipitate-filled precipitation zone G1 and to return the enriched solvent to enriched solvent evaporator E1.

The lean solvent flows from solvent pump D1 through line 42 and open valve 44 into line 30. Valve 32 is closed and valve 35 is open, allowing solvent to flow through line 34 and subsequently through line 14 into the first precipitation zone G1. Valves 39 and 22 are closed and the solvent, enriched in triamantane, returns to solvent evaporator E1 through line 46 and open valve 47. Solvent flow through the first precipitation zone G1 continues until substantially all of the triamantane-enriched precipitate is dissolved and removed. This generally requires between about 1 and about 3 precipitation zone volumes of fresh solvent.

When the precipitation zone rinse step is completed, the solvent evaporator E1 temperature is elevated to a temperature sufficient to boil off the solvent while retaining solid triamantane-enriched material within the solvent evaporator. Typical solvent evaporator temperatures for the solvents referred to above are about 120° F. to about 175° F. If carbon disulfide is used as the solvent, the solvent evaporator is heated to a temperature of from about 125° to about 175° F., typically about 120° F., near the carbon disulfide boiling point 115.3° F., to evaporate the solvent, leaving behind the triamantane-enriched solids. The evaporated solvent returns to fresh solvent reservoir F1 via line 60 and open valve 61 for storage and reuse. Line 60 is connected to flare (not shown) via line 64 which is equipped with valve 65. Valve 65 is typically a pressure relief valve. Line 60 may optionally include a cooler or condenser if required to liquify the solvent for storage and reuse. During the precipitation zone rinse step, partially enriched solvent may optionally be recirculated through the precipitation zone G1 to dissolve the accumulated precipitate. At the conclusion of the precipitation zone rinse step, solvent is flushed out of the precipitation zone with the inert gas so that when natural gas flow to the precipitation zone is restarted, the precipitation zone is filled with inert gas.

When the precipitation zone G1 has been flushed with solvent and the enriched solvent is collected in solvent evaporator E1, the diamondoid solids are recovered by evaporating the solvent as described above. The solvent evaporator vessel is then opened and triamantane-enriched solids are removed. The solvent evaporator vessel may suitably comprise any commercially available heated vessel configuration, but preferably comprises a drum or kettle surrounded by an external heating coil. External heating coils are preferred to facilitate physical removal of the accumulated diamondoid solids.

Natural gas flow continues through the second precipitation zone G2 and is withdrawn through line 50 and open valve 52 until a pressure drop across the zone is noted as described above with reference to the first precipitation zone G1. Flow is then shifted back to the first precipitation zone G1 while the second precipitation zone is purged with inert gas and triamantane-rich precipitate is recovered via solvent circulation as described above with reference to the first precipitation zone G1. Specifically, triamantane-enriched solids deposited in the second precipitation zone G2 dissolve in the circulating solvent which is withdrawn from fresh solvent reservoir F1 and charged through solvent pump D1 through line 42 and open valve 44 as described above. Valve 35 is closed, and the solvent flows through line 36 and open valve 37, through line 16 into the second precipitation zone G2. The triamantane-enriched solvent is withdrawn from the second precipitation zone G2 through line 50. Valve 52 is closed, diverting flow from line 50 through line 58 and open valve 59 to line 46 which returns the triamantane-enriched solvent to the solvent evaporator E1.

The natural gas stream, now containing diamantane but essentially no triamantane, is withdrawn from the first precipitation stage and is charged to at least one of the diamantane precipitation zones of the second precipitation stage.

The operation of the second precipitation stage is similar in principle to that of the first with the exception that the third and fourth precipitation zones, G3 and G4, are controlled at a lower temperature than the first two precipitation zones, G1 and G2. Specifically, during operation, the temperature of precipitation zones G3 and G4 is controlled within the range of about 100° to about 110° F.

The natural gas stream flows from the first precipitation stage, where triamantane-enriched precipitate was removed, to the second precipitation stage, where the stream is cooled to recover diamantane-enriched precipitate. Lines 20 and 50 are teed into line 70 which conveys the natural gas stream from the first precipitation stage to the second precipitation stage. Line 70 tees into lines 72 and 74, which are equipped with valves 73 and 75, respectively. The second precipitation stage comprises two parallel precipitation zones, G3 and G4, operates in a continuous/swing mode similar to that of the first precipitation stage. Thus to route natural gas through the third precipitation zone G3, valve 73 is open and the natural gas stream flows through line 72 into the third precipitation zone G3.

Temperature within the third precipitation zone G3 ranges from about 100° to about 110° F., and is typically about 100° F., controlled by cooler A3. Diamantane-enriched solids precipitate in the third precipitation zone G3 and the purified natural gas stream is withdrawn via line 80 and open valve 82. When pressure drop across the third precipitation zone G3 has increased to about 1–2 psi, natural gas flow is discontinued by closing valve 73, and the third precipitation zone G3 is cooled and purged with a cold vaporized inert gas, preferably vaporized carbon dioxide as described above with reference to the first precipitation zone G1. For the inert gas purge, valve 92 is open and valve 104 is closed, allowing the inert gas to vaporize from a second inert gas reservoir C2, flowing through lines 90 and 94, through the third precipitation zone G3. The mixture of inert gas and natural gas withdrawn from the third precipitation zone G3 through line 80 is sent to flare (not shown) via line 84 and open valve 85.

Solvent circulation in the second precipitation stage is substantially identical to that of the first precipitation stage as described above. Solvent from fresh solvent reservoir F2 flows through line 100 to solvent circulation pump D2, through line 102 and open valve 104 and into line 90. To route the solvent through the third precipitation zone G3, valve 97 is closed and the solvent flows through line 94 and open valve 95 to line 72 which charges the solvent to the inlet of the third precipitation zone G3. The diamantane-enriched solids deposited in the third precipitation zone G3 readily dissolve in the circulating solvent which is returned to a second evaporator E2 through line 86 and open valve 87.

During the inert gas purge and solvent circulation steps in the third precipitation zone G3, natural gas flows through the fourth precipitation zone G4 for continuous recovery of diamantane-enriched solids. Natural gas flow through the fourth precipitation zone G4 continues until the pressure drop across the fourth precipitation zone G4 reaches a predetermined level, at which time natural gas flow is shifted back to the third precipitation zone G3. In a manner similar to the procedures described above, the fourth precipitation zone G4 is then purged with cold vaporized inert gas from the second inert gas reservoir C2, which flows through lines 90 and 96, through the open valve 97 and into line 74 where it is charged to the inlet of the fourth precipitation zone G4. The mixture of natural gas and inert gas is then withdrawn from the fourth precipitation Zone G4 and flared via line 114 and open valve 116. Next, solvent is circulated through the fourth precipitation zone G4 from fresh solvent reservoir F2 through solvent circulation pump D2, through line 102 and open valve 104 and into line 90. To route the solvent through the fourth precipitation zone G4, valve 95 is closed and the solvent flows through line 96 and open valve 97 to line 74 which charges the solvent to the inlet of the fourth precipitation zone G4. The triamantane-enriched solids deposited in the fourth precipitation zone G4 readily dissolve in the circulating solvent which is returned to a second evaporator E2 through line 120. The evaporated solvent then returns to fresh solvent reservoir F2 as described above with reference to fresh solvent reservoir F1. The diamantane-enriched solids are then recovered from solvent evaporator E2 as described above with reference to triamantane-enriched solids and solvent evaporator E1. The purified natural gas stream is then withdrawn from the second stage of the diamondoid recovery apparatus via line 130 for further processing and sale.

EXAMPLE

Natural gas as characterized in Tables 1 and 2, below, is produced from a wellhead at a rate of 15 MMSCFD (million standard cubic feet per day) at 6000 psia and 260° F. The natural gas stream is charged through a choke to reduce pressure to about 1200 psia while heat tracing on the choke and the associated lines maintains the average natural gas temperature downstream of the choke at 260° F. The natural gas stream is charged to a diamondoid precipitation unit comprising two sets of two controlled temperature precipitation zones piped in parallel for continuous/swing operation for two-stage diamondoid precipitation. The four zones are piped in a series/parallel configuration such that one zone of each parallel pair is available for diamondoid precipitation and one zone is available for solvent flushing for dissolution of the accumulated diamondoids.

TABLE 1

Example Diamondoid Concentration in Dry Natural Gas Sample

| Component | Concentration lbs/mmscf | Concentration ppm |
|---|---|---|
| adamantane | 15 | 300 |
| 1-methyladamantane | 30 | 600 |
| 1,3-dimethyladamantane | 18 | 360 |
| 1,3,5-trimethyladamantane | 4 | 80 |
| diamantane | 9 | 180 |
| 4-methyldiamantane | 5 | 100 |
| 1-methyldiamantane | 6 | 120 |
| triamantane | 2 | 40 |
| methyltriamantane | 1 | 18 |

TABLE 2

Example Dry Natural Gas Composition (after processing)

| | Mole Percent |
|---|---|
| hydrogen sulfide | 7.1 |
| nitrogen | 0.4 |
| methane | 88.0 |
| ethane | 0.8 |
| carbon dioxide | 3.6 |
| propane | 0.1 |

The first two precipitation zones are maintained at a temperature of 190° F. and pressure of 1200 psia to selectively precipitate from the natural gas stream a mixture of solids highly enriched in triamantane.

The first two precipitation zones are contained in 316L stainless steel tubular conduits having length of 4 feet and an inside diameter of 4 inches. Each stainless steel conduit contains a sintered stainless steel filter (dimensions: 4 inch nominal inside diameter and 2 foot length) for collecting triamantane-enriched precipitate. Thus the total volumetric capacity of the first precipitation zone is about 13,000 cc, due to the fact that the porosity of the filter is less than about 1. The maximum capacity of the first precipitation zone is about 34 pounds of triamantane, but pressure drop across the first precipitation zone requires that the zone be flushed with solvent after about 9 pounds of triamantane have accumulated. For the stated natural gas compositions and flowrates, about 2.6 pounds of triamantane and methyltriamantane precipitate per million standard cubic feet of natural gas flow upon cooling from 260° to 190° F. at the operating pressure of 1200 psig. Small amounts of other diamondoids also precipitate, but the resulting solid is highly enriched in triamantane, thus demonstrating the effectiveness of separating diamondoid fractions by the present method.

The stainless steel conduit is immersed in a constant temperature water bath at 190° F. When the pressure drop across the first precipitation zone reaches 1–2 psi, (generally after accumulating about 9 pounds of triamantane, or after about 1.5 hours of natural gas flow at 15 MMSCFD), the natural gas flow through the first precipitation zone is discontinued and the first precipitation zone is purged with cold vaporized carbon dioxide until the temperature of the first precipitation zone reaches 70° F. The mixture of carbon dioxide and purged natural gas is vented to flare. Next, carbon disulfide (b.p. 46.3° C., 115.3° F.) is circulated through the first precipitation zone. The accumulated triamantane typically requires about 4 pounds of solvent per pound of triamantane dissolved, or about 6 gallons of solvent for every 9 pounds of triamantane. The precipitation zone is therefore flushed three times with a total of about 10 gallons of solvent.

The enriched solvent is then displaced to a heated evaporator vessel at temperature of 120° F. and the resulting vapors are condensed and recovered for reuse, leaving triamantane-enriched solids in the evaporator vessel. The evaporator vessel is then periodically opened and triamantane-enriched solids are physically removed.

When the solvent rinse is completed, the first precipitation zone remains out of service until the second precipitation zone requires solvent rinse. The second precipitation zone, identical in configuration to the first, is then charged with natural gas and the triamantane recovery stage is continued.

The natural gas effluent from the triamantane recovery stage is then charged to a second, lower temperature diamantane precipitation stage. The second stage comprises two precipitation zones (the third and fourth precipitation zones) configured for parallel/swing operation as described above with reference to the triamantane recovery stage. In the diamantane recovery stage, however, more precipitation zone volume is required. Thus the third and fourth precipitation zones are contained in 316L stainless steel tubes as described above with the exception that the tubes for the third and fourth precipitation zones have inside diameters of approximately 8 inches, with each of the third and fourth precipitation zones thus providing maximum diamantane precipitation capacity of about 136 pounds.

Upon entering the diamantane recovery stage, the natural gas stream is routed to either the third or the fourth precipitation zone where it is cooled to an average temperature of 100° F. at a pressure of 1200 psia. Diamantane solids contained in the natural gas stream precipitate and form a solid within the third precipitation zone, depositing about 8.6 pounds of diamantane-enriched solids per million standard cubic feet of natural gas processed.

The stainless steel conduit is immersed in a constant temperature water bath at 100° F. When the pressure drop across the first precipitation zone reaches 1–2 psi, (generally after accumulating about 34 pounds of diamantane, or after about 1.5 hours of natural gas flow at 15 MMSCFD), the natural gas flow through the third precipitation zone is discontinued and the third precipitation zone is purged with cold vaporized carbon dioxide until the temperature of the third precipitation zone reaches 70° F. The mixture of carbon dioxide and purged natural gas is vented to flare. Next, carbon disulfide (b.p. 46.3° C., 115.3° F.) is circulated through the third precipitation zone. The accumulated diamantane typically requires about 4 pounds of solvent per pound of diamantane dissolved, or about 6 gallons of solvent for every 9 pounds of diamantane. The precipitation zone is therefore flushed three times with a total of about 10 gallons of solvent.

The enriched solvent is then stored in a heated evaporator vessel at temperature of 120° F. and the resulting vapors are condensed and recovered for reuse, leaving diamantane-enriched solids in the evaporator vessel, which is periodically opened for diamantane removal as described above.

When the solvent rinse of the third precipitation zone is completed, the third precipitation zone remains out of service until the fourth precipitation zone requires solvent rinse. The fourth precipitation zone, identical in configuration to the third, is then charged with natural gas and the diamantane recovery stage is continued.

Changes and modifications in the specifically described embodiments can be carried out without departing from the scope of the invention which is intended to be limited only by the scope of the appended claims.

What is claimed is:

1. A method for recovering and separating diamondoid compounds from a natural gas stream having diamondoid compounds dissolved therein comprising the steps of:

(a) providing a natural gas reservoir containing a recoverable concentration of diamondoid compounds dissolved therein;

(b) withdrawing a natural gas stream containing diamondoid compounds from said natural gas reservoir at production wellhead pressure;

(c) depressuring and heating said natural gas stream to maintain said diamondoid compounds in solution with said natural gas;

(d) transferring said depressured natural gas stream of step (c) to a first precipitation zone while controlling temperature and pressure to maintain said diamondoid compounds in solution with said natural gas upstream of said first precipitation zone;

(e) cooling said depressured natural gas stream of step (d) within said first precipitation zone to a temperature sufficient to evolve a triamantane-enriched solid precipitate;

(f) collecting said triamantane-enriched solid precipitate within said first precipitation zone in the substantial absence of diamantane-enriched precipitate;

(g) discontinuing natural gas flow to said first precipitation zone;

(h) flushing said first precipitation zone with a solvent to dissolve said triamantane-enriched solid precipitate, said solvent being characterized by boiling point range at atmospheric pressure of from about 70 to about 125° F.;

(i) collecting said triamantane-enriched solvent of step (h);

(j) recovering triamantane-enriched solid from said collected solvent of step (i);

(k) transferring said cooled depressured natural gas stream of step (e) containing essentially no triamantane to a second precipitation zone while controlling temperature and pressure to retain the remaining diamondoid compounds in solution with said natural gas upstream of said second precipitation zone;

(l) cooling said depressured natural gas stream of step (d) within said second precipitation zone to a temperature sufficient to evolve a diamantane-enriched solid precipitate;

(m) collecting said diamantane-enriched solid precipitate within said second precipitation zone in the substantial absence of triamantane-enriched precipitate;

(n) discontinuing natural gas flow to said second precipitation zone;

(o) flushing said second precipitation zone with a solvent to dissolve said diamantane-enriched solid precipitate, said solvent being characterized by boiling point range at atmospheric pressure of from about 70 to about 125° F.;

(p) collecting said diamantane-enriched solvent of step (o); and (q) recovering diamantane-enriched product from said collected solvent of step (p).

2. The process of claim 1 further comprising accumulating said triamantane-enriched precipitate on a porous solid within said first precipitation zone.

3. The process of claim 1 further comprising accumulating said diamantane-enriched precipitate on a porous solid within said second precipitation zone.

4. The process of claim 1 further comprising providing metallic or nonmetallic solid inert particles within said first and said second precipitation zones to facilitate precipitation.

5. The process of claim 1 wherein said solvent is selected from the group consisting of carbon disulfide, chloroform, and one or more hydrocarbons having a boiling endpoint of less than about 125° F. at atmospheric pressure.

6. The process of claim 5 wherein said solvent is carbon disulfide.

7. The process of claim 1 wherein said inert gas is carbon dioxide.

8. The process of claim 1 wherein said recovery step (j) further comprises evaporating said solvent to produce triamantane-enriched solids.

9. The process of claim 1 wherein said recovery step (q) further comprises evaporating said solvent to produce diamantane-enriched solids.

* * * * *